US006719191B1

(12) United States Patent
Christensen et al.

(10) Patent No.: US 6,719,191 B1
(45) Date of Patent: Apr. 13, 2004

(54) STACKABLE BLISS-TYPE CONTAINER

(75) Inventors: Stephen M. Christensen, Yakima, WA (US); Thomas E. Rodgers, Yakima, WA (US)

(73) Assignee: Longview Fibre Company, Longview, WA (US)

( * ) Notice: Subject to any disclaimer, the term of this patent is extended or adjusted under 35 U.S.C. 154(b) by 0 days.

(21) Appl. No.: 10/226,703

(22) Filed: Aug. 22, 2002

(51) Int. Cl.[7] ..... B65D 5/32; B65D 21/032

(52) U.S. Cl. ..... 229/122.26; 206/509; 229/122.32; 229/191; 229/918; 229/919

(58) Field of Search ..... 229/122.24, 122.26, 229/122.32, 191, 915, 918, 919; 206/509, 512

(56) References Cited

U.S. PATENT DOCUMENTS

| | | | | | |
|---|---|---|---|---|---|
| 1,697,709 | A | * | 1/1929 | Bliss | 229/122.26 |
| 2,089,345 | A | | 8/1937 | Davis et al. | |
| 3,099,379 | A | | 7/1963 | Stease | |
| 3,375,967 | A | | 4/1968 | Robinson | |
| 3,850,362 | A | | 11/1974 | Stollberg et al. | |
| 3,899,123 | A | | 8/1975 | Stollberg et al. | |
| 4,389,013 | A | * | 6/1983 | Hall et al. | 229/915 |
| 4,709,852 | A | * | 12/1987 | Stoll | 206/509 |
| 4,948,033 | A | * | 8/1990 | Halsell, II et al. | 229/918 |
| 5,125,568 | A | | 6/1992 | Bauer | |
| 5,335,844 | A | * | 8/1994 | Young | 229/919 |
| 5,390,847 | A | * | 2/1995 | Young | 229/918 |
| 5,597,111 | A | * | 1/1997 | Mackinnon et al. | 229/919 |
| 5,779,136 | A | * | 7/1998 | Blazquez Garcia | 229/918 |
| 6,186,393 | B1 | | 2/2001 | Tsamourgelis | |

FOREIGN PATENT DOCUMENTS

| | | | | | |
|---|---|---|---|---|---|
| EP | 306600 | A2 | * | 3/1989 | 229/918 |
| GB | 2226546 | A | * | 7/1990 | 229/918 |
| GB | 2232404 | A | * | 12/1990 | 229/918 |

* cited by examiner

*Primary Examiner*—Gary E. Elkins
(74) *Attorney, Agent, or Firm*—Chernoff, Vilhauer, McClung & Stenzell LLP

(57) ABSTRACT

A bliss-type, corrugated paperboard container having an open top for transporting and displaying fruit, vegetables and the like has a main piece, which provides a bottom element and opposed first side elements, and two bliss pieces which are adhesively attached to the main piece and provide opposed second side elements. The second side elements include an inner panel having extremities which are separated from the first side elements. Diagonal pieces, attached to the extremities of each inner panel, extend to the first side panels, and second side flaps extend from the diagonal pieces to overlie portions of the first side panels. An outer panel of the second side element extends between the first side elements. Indexing tabs have first ends which are connected to the inner panels and second ends which are connected to the outer panels. The indexing tabs are bent 180° between the first and second ends. The indexing tabs fit into slots located in the bottom of a stacked container.

11 Claims, 6 Drawing Sheets

16
50
52
53
54
55
56
58
63
22
28
29
36
38
40
42
44
46
12

STACKABLE BLISS-TYPE CONTAINER

BACKGROUND AND SUMMARY OF THE INVENTION

This invention relates to an open-topped, stackable, corrugated paperboard container for transporting and displaying fruit, produce, or similar items.

It is becoming common in large supermarkets and discount stores to sell fruit, vegetables and similar items out of the paperboard containers that they are shipped in. These containers are open-topped and are stacked on top of one another during shipment and display. When the top container is empty it is simply removed from the stack exposing the next full container. Since fruit and produce are sold with a low profit margin and these containers often are disposed of after a single use, the cost of the containers becomes a factor in the cost of the product being sold out of them. In addition, it is important that these containers be stacked squarely on top of one another or the stack will become unstable. Typically, indexing tabs, which protrude from the top edges of a lower container, fit into indexing slots in the bottom of the upper container to ensure that the containers stack properly. However, the edge of a piece of corrugated paperboard is easily damaged and if the tabs become damaged they will not fit easily into the slots. In order to keep the containers stacked squarely when the tabs do not fit cleanly into the slots, containers of this type often have diagonal comers which support the bottom of a stacked container. Finally, this type of container often is a bliss-type container which is relatively inexpensive to construct. However, if a bliss-type container has diagonal elements at the comers, the side walls on the bliss pieces will not extend completely to the end walls on the main piece and the containers end up skewed slightly when the bliss pieces are attached to the main piece. This also effects the stackability of the container.

The subject invention provides a container in which the bliss elements have an outer panel which extends to the inside surface of the end elements of the main piece to facilitate squaring a container upon assembly, and an inner panel which does not extend to the side elements of the main piece and has the diagonal pieces attached to its extremities.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
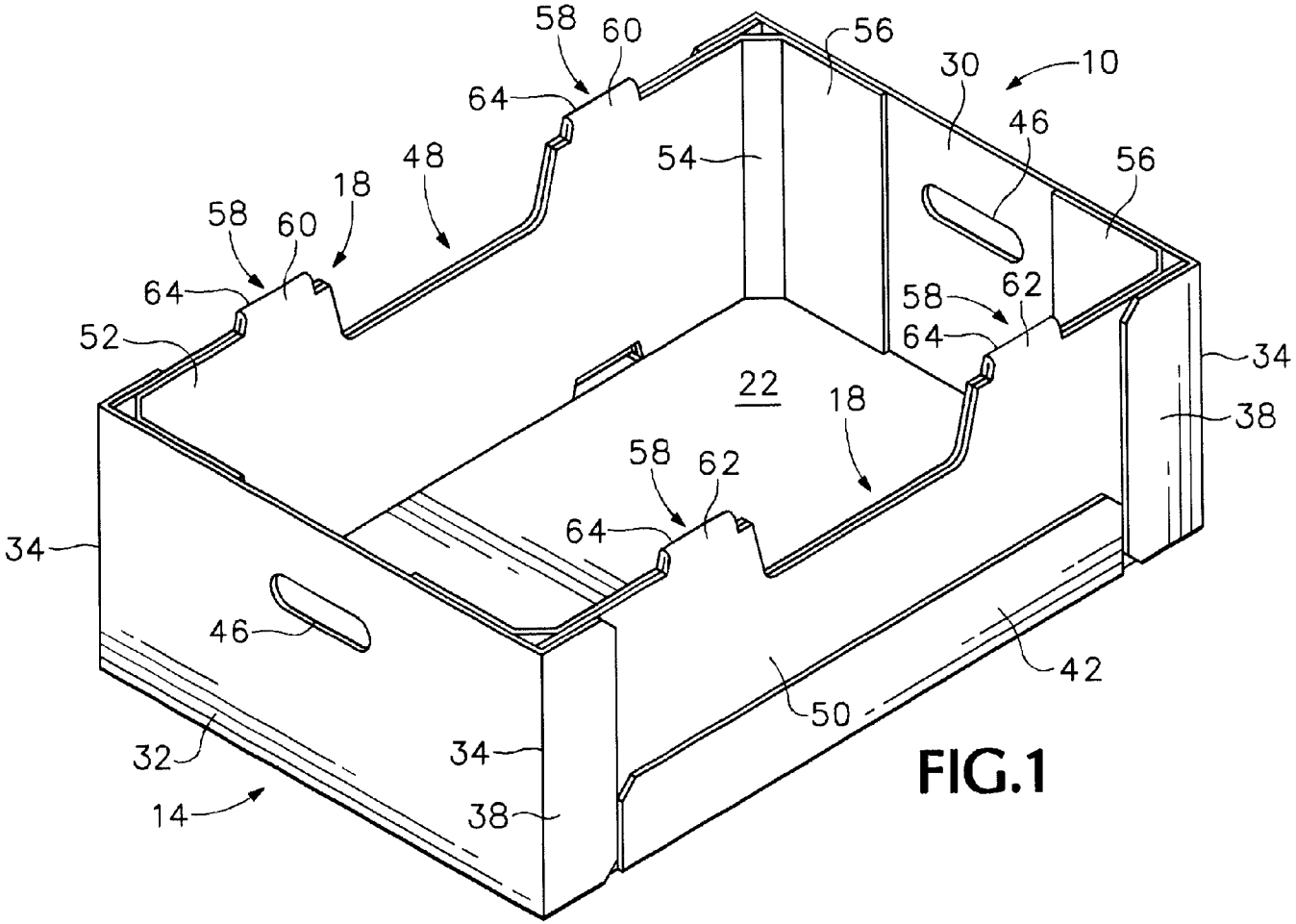
FIG. 1 is a perspective view of a container embodying the subject invention.
Figures 2, 3:
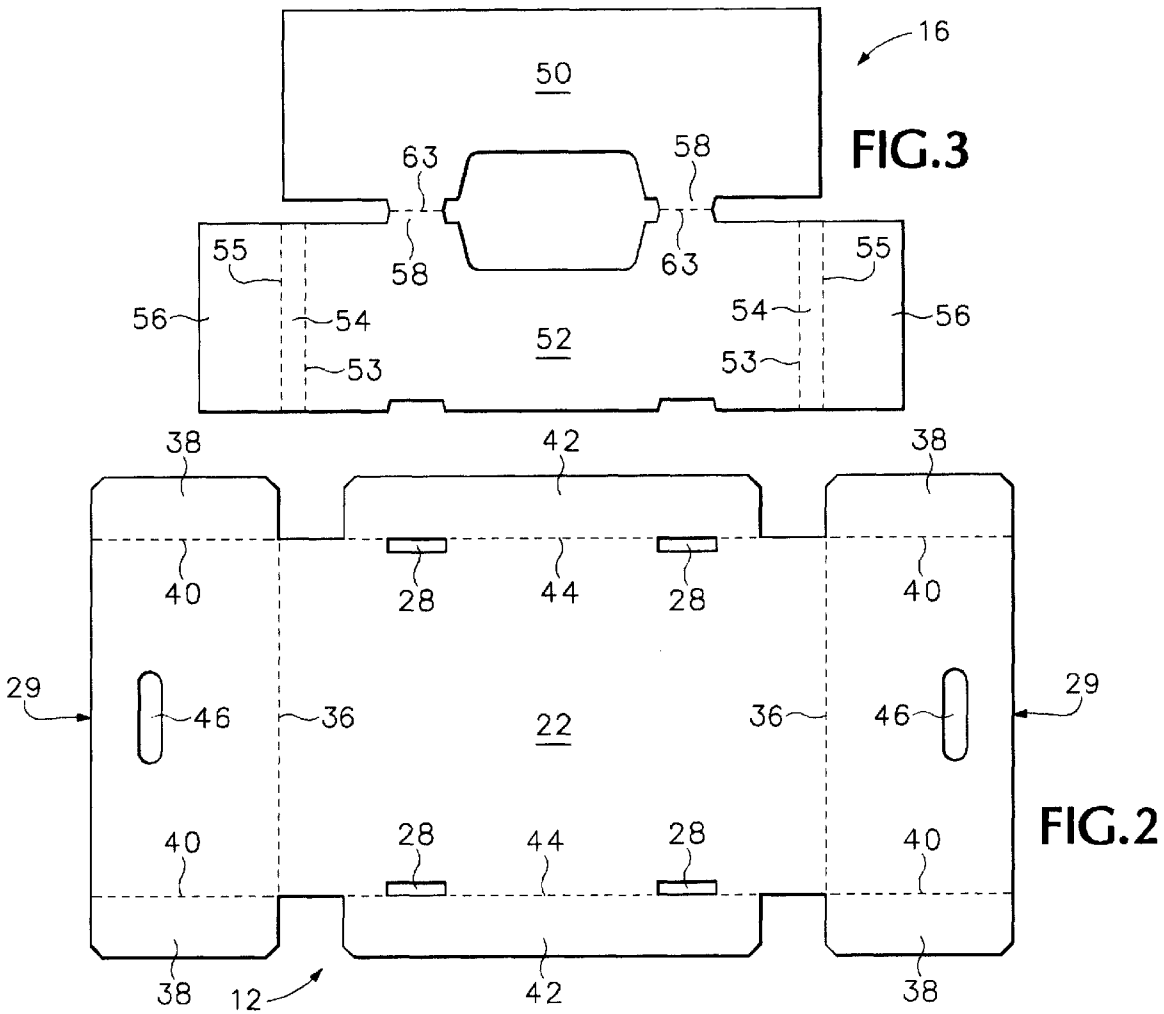
FIG. 2 is a plan view of a blank which forms the main piece of the container.
FIG. 3 is a plan view of a blank which forms the bliss pieces of the container.

Referring now to FIG. 1 of the drawings, an open topped, stackable, corrugated paperboard container 10 has a bliss-style construction and is intended for shipment and display of fruit, produce and other goods. Referring now also to FIGS. 2–5, the container is made from a main blank 12, FIG. 2, which is used to form a main piece 14, FIG. 4, and two bliss blanks 16, FIG. 3, which are used to form two bliss pieces 18, FIG. 5. Typically, multiple pieces are cut from a single sheet of corrugated paperboard.

Figure 4:
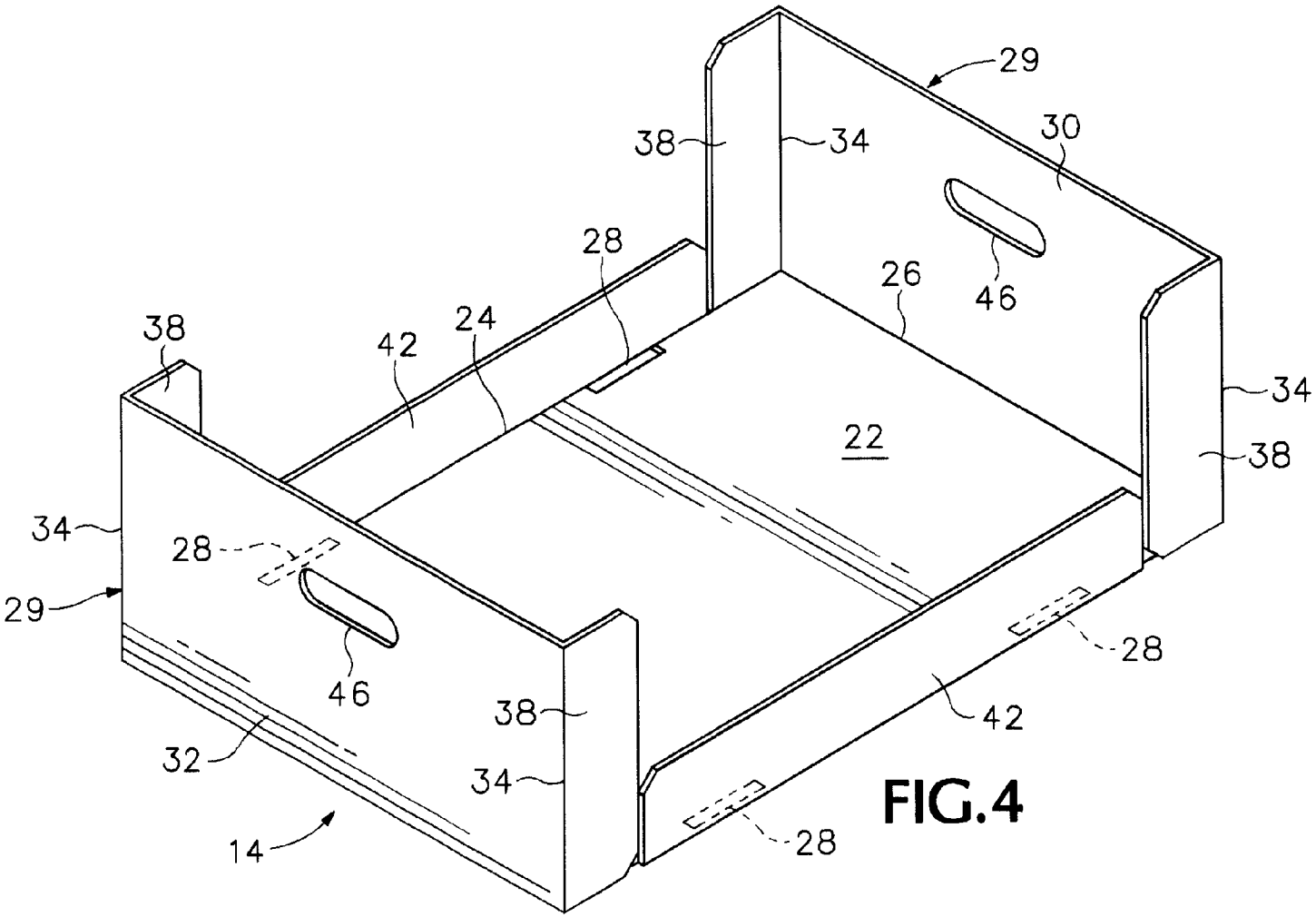
FIG. 4 is a perspective view showing the main piece erected.
Figure 5:
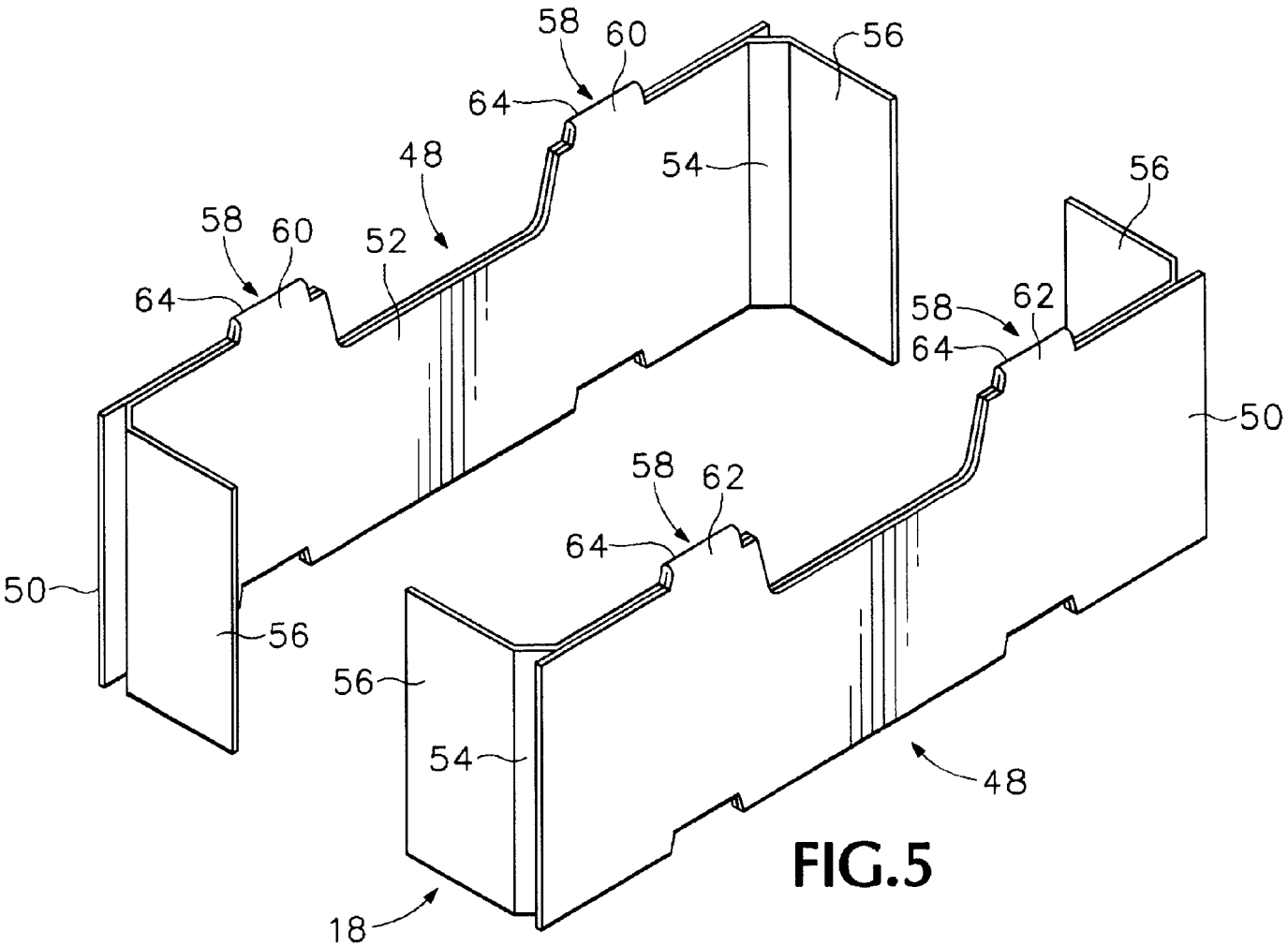
FIG. 5 is a perspective view showing the bliss pieces erected.
Figure 6:
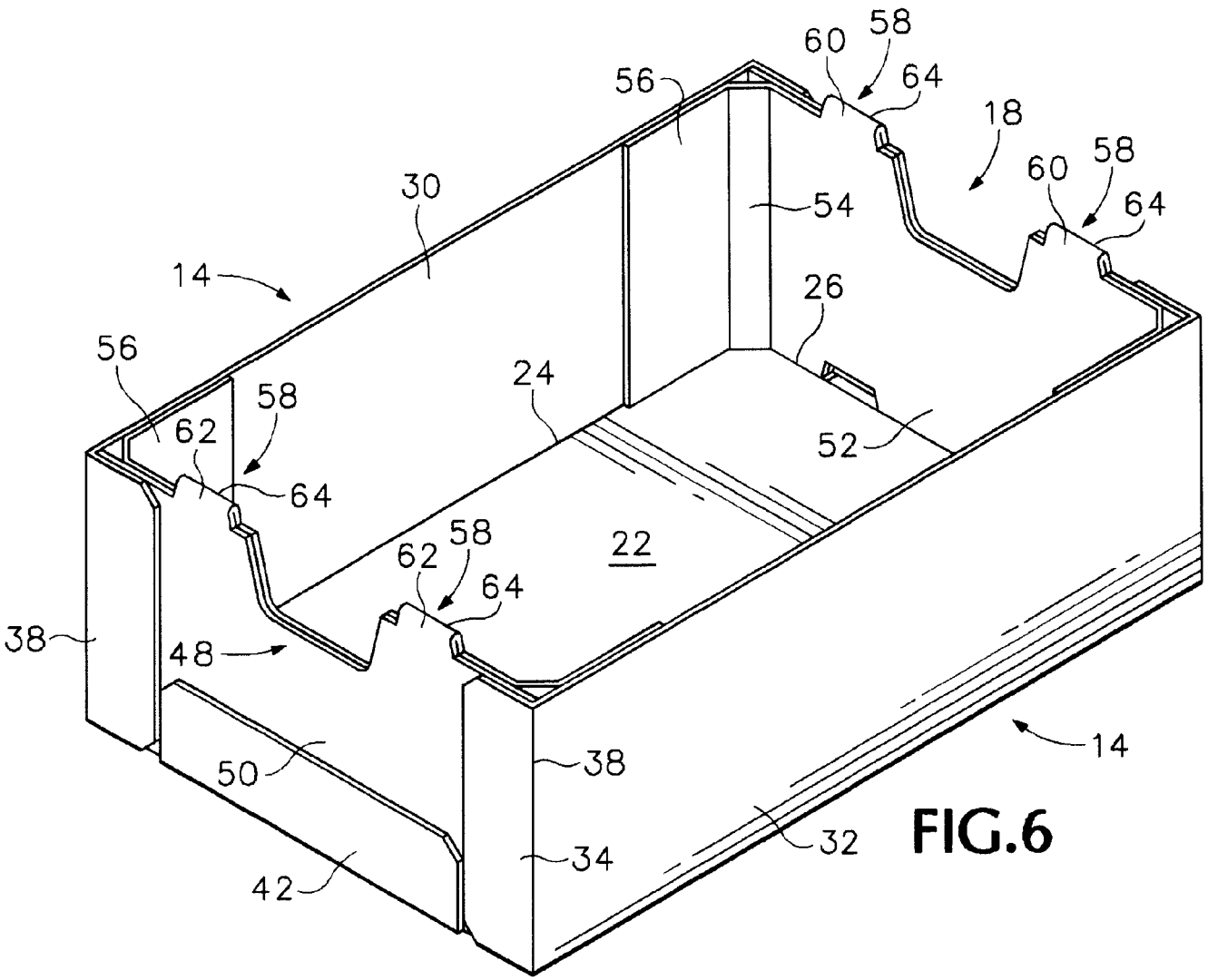
FIG. 6 is a perspective view of a container showing another embodiment of the invention.

The main piece 14 has a rectangular bottom element 22. The bottom is shown as having opposed longer edges 24 and opposed shorter edges 26, but it could be square as well. Indexing slots 28 are located in the bottom element along the edges that are adjacent the bliss pieces 18. This could be either the long edges, as shown in FIGS. 1 and 4, or the shorter edges 26, as shown in FIG. 6. Two indexing slots are shown in each edge but there could be more or less depending on the size of the container.

Connected to the edges of the bottom pieces that are not attached to the bliss pieces are opposed first side elements 29, which have an inside surface 30 and an outside surface 32 and opposed ends 34. The first side elements 29 are bent upwardly 90° with respect to the bottom 22 along fold lines 36. First side flaps 38 are connected to each edge 34 of the first side elements 32. The first side flaps are bent inwardly 90° with respect to the first side elements along fold lines 40. Connected to the edges of the bottom panel that are adjacent to the bliss pieces are opposed bottom flaps 42. The bottom flaps are bent upwardly 90° with respect to the bottom 22 along fold lines 44. Hand holes 46 may be placed in the first side elements 29 to facilitate lifting the container.

The bliss pieces 18 each include a second side element 48 having an outer panel 50 with a length that is substantially equal to the distance between the first side elements 29, and an inner panel 52, which is shorter than the outer panel 50. Connected to each of the ends of the inner panels 52, along fold lines 53, are diagonal pieces 54 which extend on a diagonal to the inside surfaces 30 of the first side elements 29, when the bliss pieces 18 are inserted into the main piece 14. Connected to each diagonal piece, along a fold line 55, is a second side flap 56 which overlays a portion of the inside surface 30 of the first side element 29 when the bliss pieces are inserted into the main pieces.

Figure 7:
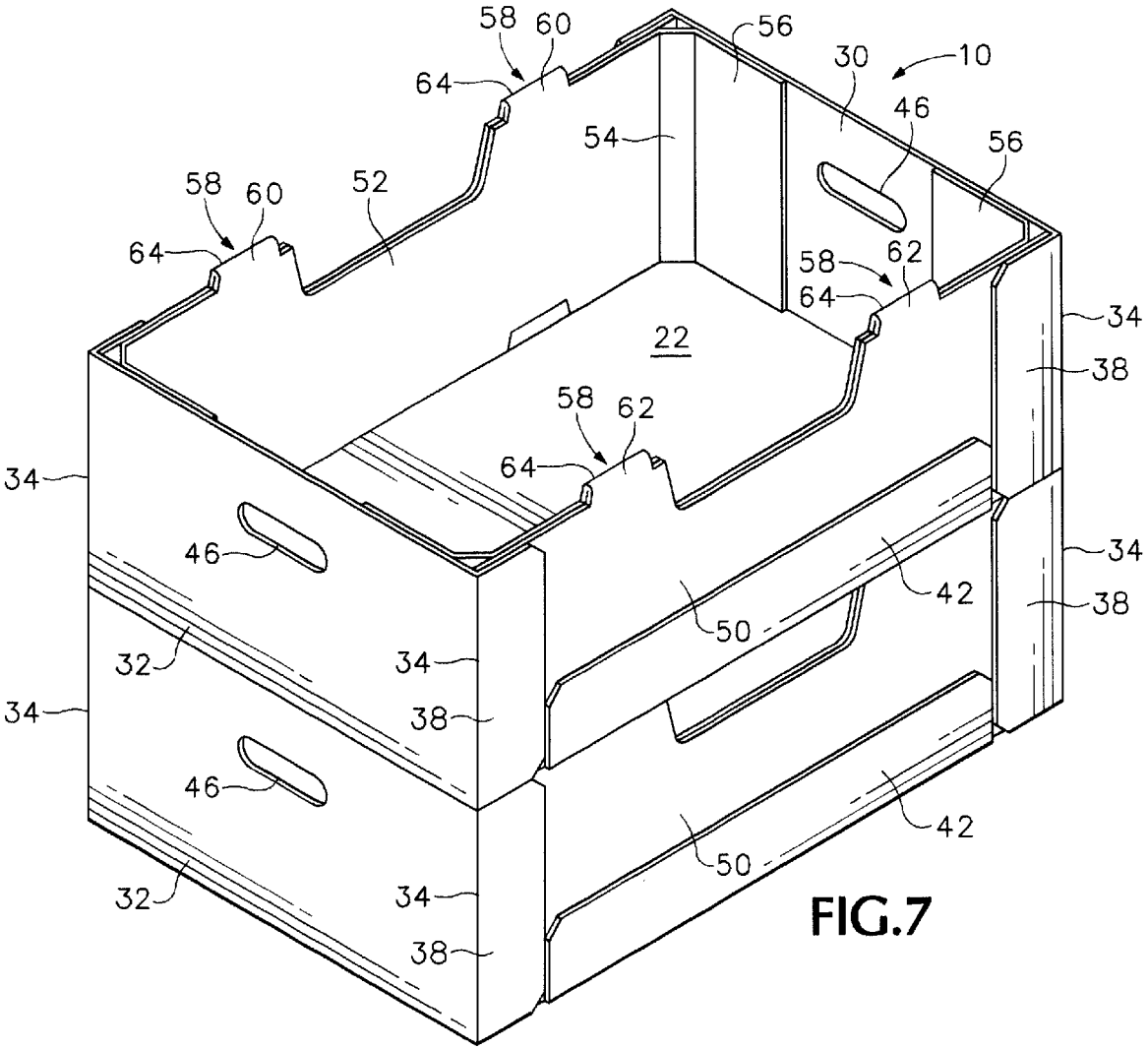
FIG. 7 is a perspective view of two of the containers of FIG. 1 stacked together.

Indexing tabs 58 have first ends 60 which are connected to the inner panels 52, and second ends 62 which are connected to the outer panels 50. The indexing tabs are folded 180° along fold lines 63 midway between their ends to provide folded outer edges 64. The indexing tabs are arranged to fit into the indexing slots 28 when one container is stacked on top of another container, as shown in FIG. 7.

The container is formed in the standard manner in a bliss container machine. The main blank 12 is folded along fold lines 36, 40 and 44 and the two bliss blanks 16 are folded along fold lines 53 and 55. An adhesive is placed on the outside surfaces of the second side flaps 56 and on the inside surfaces of the first side flaps 38 and the bliss blanks are inserted into and adhered to the main blank. The bliss blanks are then folded along fold lines 63 and the outer panels 50 are adhesively attached to the inner panels 52.

The resulting container can easily be stacked. The folded outer edges 64 of the indexing tabs 58 allow the indexing tabs to be inserted into the indexing slots 28 without being damaged and the diagonal elements 54 prevent a container from slipping into the container it is stacked on in the event the indexing tabs on one end of the container are not placed on the indexing slots.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A bliss-type, corrugated paperboard container comprising:

(a) A main piece having a bottom element and opposed first side elements which have inside surfaces and outside surfaces, and opposed ends;

(b) A first side flap connected to each end of each said first side element, said first side flaps being oriented at 90 degrees with respect to said first side elements;

(c) a pair of opposed bliss pieces, each having a second side element, which extends between the ends of said first side elements;

(d) each said second side element including an inner panel having opposed extremities which are spaced apart from the inside surfaces of said first side elements and an outer panel having opposed extremities which extend substantially to the inside surface of said first side elements;

(e) a diagonal piece which is attached to each extremity of each said inner panel extends diagonally between said inner panel and said inside surface of said first side element; and (f) a second side flap which is attached to each diagonal piece overlays a portion of the inside surface of said first side elements.

2. The container of claim 1 wherein said bottom element has one or more indexing slots defined therein, and said second side elements have one or more indexing tabs having first ends which are connected to said inner panels and second ends which are connected to said outer panels and are folded 180 degrees between said first and second ends, said indexing tabs being located to fit into said indexing slots when one container is stacked on top of another container.

3. The container of claim 1 including a pair of bottom flaps which are connected to said bottom element, said bottom flaps being oriented 90 degrees with respect to said bottom element and extending substantially between opposed ones of said first side flaps.

4. The container of claim 2 wherein said bottom element is rectangular with opposed long edges and opposed short edges and said first side elements are connected to said short edges.

5. The container of claim 2 wherein said bottom element is rectangular with opposed long edges and opposed short edges and said first side elements are connected to said long edges.

6. The container of claim 4 wherein there are four of said indexing slots, and two are located along each long edge of said bottom element.

7. The container of claim 1 wherein said second side flaps are attached to said first side elements by an adhesive.

8. The container of claim 1 wherein said inner panels are attached to said outer panels by an adhesive.

9. The container of claim 1 wherein said outer panels are attached to said first side flaps by an adhesive.

10. The container of claim 3 wherein said outer panels are attached to said bottom flaps by an adhesive.

11. The container of claim 2 wherein said inner panel, said second side flaps, said diagonal elements, said outer panel, and said tabs of each said second side element are an integral piece.

* * * * *